US006619500B1

(12) United States Patent
Lantz

(10) Patent No.: US 6,619,500 B1
(45) **Date of Patent: *Sep. 16, 2003**

(54) COMPARTMENTALIZED INSULATED SHIPPING CONTAINER

(76) Inventor: Gary W. Lantz, 24282 Lysanda Dr., Mission Viejo, CA (US) 92691

( * ) Notice: Subject to any disclaimer, the term of this patent is extended or adjusted under 35 U.S.C. 154(b) by 0 days.

This patent is subject to a terminal disclaimer.

(21) Appl. No.: 09/724,161

(22) Filed: Nov. 28, 2000

Related U.S. Application Data

(60) Continuation-in-part of application No. 09/228,156, filed on Jan. 11, 1999, now Pat. No. 6,257,764, which is a division of application No. 08/633,154, filed on Apr. 16, 1996, now Pat. No. 5,897,017.

(51) Int. Cl.[7] ..... B65D 23/00
(52) U.S. Cl. ..... 220/592.1; 220/592.25
(58) Field of Search ..... 206/525, 524; 220/592.1, 592.25, 592.09, 592.2

(56) References Cited

U.S. PATENT DOCUMENTS 3,613,933 A * 10/1971 Pilz et al. ..... 206/525
3,799,386 A * 3/1974 Madalin et al. ..... 206/564
4,136,141 A * 1/1979 Bauer et al. ..... 206/524
4,368,819 A * 1/1983 Durham ..... 206/544
4,658,567 A * 4/1987 Arada ..... 206/524
5,897,017 A * 4/1999 Lantz ..... 220/592.1
5,924,302 A 7/1999 Derifield

* cited by examiner

*Primary Examiner*—Joseph M. Moy
(74) *Attorney, Agent, or Firm*—Terry L. Miller

(57) ABSTRACT

An insulated shipping container includes a body of foamed polymer material. This body defines a plurality of compartments, an opening from each compartment outwardly to ambient, a transition surface surrounding each opening, and an exterior surface. Preferably, the compartments and exterior surface are both like shapes so that a uniformly thick wall of insulative foamed polymer material is provided between the respective compartments and ambient. A single sheet of plastic is integrally bonded to the foamed polymer body and is configured such that it faces all of each compartment within the body, the transition surface, and a substantial portion of the exterior surface of the container. A machine for constructing an insulated shipping container with plural compartments is disclosed. A heat-sealing apparatus or machine with a table-like upper surface and a cavity surrounded on three sides by a heat-sealing margin and a vacuum source may hold two plastic sheets in place while the sheets are heat-sealed thus creating a plastic bag which is trimmed from the sheets. This plastic bag is configured for use in making an insulated shipping container.

6 Claims, 6 Drawing Sheets

110
120b
115
118a
116
112
118
122c
172
172
120a
122c
114

COMPARTMENTALIZED INSULATED SHIPPING CONTAINER

CROSS REFERENCE TO RELATED APPLICATIONS

This application is a Continuation-in-Part from U.S. application Ser. No. 09/228,156, filed Jan. 11, 1999 now U.S. Pat. No. 6,257,784; which is a Divisional application of issued U.S. application Ser. No. 08/633,154 filed Apr. 16, 1996 now U.S. Pat. No. 5,897,017, both entitled, "Insulated Shipping Container, Method of Making, and Article and Machine Used in Making," the disclosure of which is incorporated herein by reference to the extent necessary for a complete and enabling disclosure of the present invention.

BACKGROUND OF THE INVENTION

1. Field of the Invention

The present invention is in the field of shipping containers. More particularly, the present invention relates to a shipping container which is insulated in order to maintain an article shipped in the container at a refrigerated temperature for a period of time, for example, while the container and it's contents are in shipment. Still more particularly, the present invention relates to such a container; which is formed at least in part of foamed polymer material, to an article used in the manufacture of the container, and to a machine used to carry out the manufacture of the container.

2. Related Technology

Conventional insulated shipping containers of the so-called box-within-a-box configuration are well known. These conventional box-within-a-box containers have an outer box formed of corrugated cardboard and a smaller inner open-topped box, which is also formed of corrugated cardboard. These two boxes define a void space, which during the manufacture of such a shipping container, is filled with a foamed polymer material acting as an insulating medium. During the use of such a conventional container it is common practice to insert the article or articles to be shipped into the inner box along with a piece of dry ice and perhaps some loose packing material (such as foamed styrene "peanuts") and to insert an insulating closure piece, which is a cut piece of comparatively thick closed-cell foam sheet. This closure piece is inserted at the opening of the inner box.

This and other conventional insulated shipping containers have several shortcomings. First, the box-within-a-box container is both labor intensive and material intensive to make. Secondly, the materials of this conventional container are not recyclable because the foamed polymer material bonds securely to the inner and outer cardboard boxes. Because these dissimilar materials are bonded together so securely that they cannot be conveniently separated, most recycling facilities will not accept these containers.

More seriously, these conventional containers constitute a single box-like cavity for storage of organs or other specimens without regard for the separation of such articles or the accompanying documentation or the refrigerant, such as dry ice. There are no separate compartments for each article being shipped, for the refrigerant, or for the accompanying documentation. Thus, when an article is being shipped in the container, there is no provision for documentation for the article to accompany the shipped article. There is also the possibility of the article developing cold spots at a point of contact with the dry ice or other refrigerant. Such cold spots may be a major problem when the article being shipped is a human organ for transplant.

The problem compounds even further when multiple articles are being shipped in a single container as the possibility of one article or it's accompanying documentation contaminating the entire contents of the container increases. The possibility of articles coming into contact with the refrigerant also increases, as does the possibility of mix-ups in the documentation for the articles. Often, such documentation is shipped or mailed in a separate package or envelope, with the necessity then that the documentation be properly matched up with the shipped articles. This proper matching is critical when the shipped articles are human organs for transplant.

In view of the deficiencies of the related technology, it is recognized as desirable to provide an insulated shipping container with multiple compartments. The main compartment, of which there may be one or more, may serve to receive and hold the specimen or organ, for example, being shipped in the container; while smaller secondary compartments adjacent to the main compartment may be utilized for storage of accompanying documentation or may receive a refrigerant, such as dry ice. In this way the necessary documentation may accompany the shipment without fear of it getting lost, or of contamination of the specimen being shipped by either the documentation or the refrigerant.

Other desirable features for this new insulated container are for it to be totally recyclable as well as efficient and inexpensive to make.

SUMMARY OF THE INVENTION

In view of the deficiencies of the conventional technology, an object for this invention is to overcome, or to reduce the severity of, one or more of the deficiencies of the conventional technology.

Further, as pointed out above, it is an object of this invention to provide an insulated shipping container with multiple compartments usable for transporting either a single article and it's documentation or multiple articles and their documentation without a danger of cross contamination of either the articles shipped or their documentation.

It is also an object of this invention to provide an insulated shipping container in which articles may be transported without fear of their being harmed by the refrigerant used to maintain the articles cooled during shipment.

Another object for the present invention is to provide an insulated shipping container, which is more time-efficient to make than the conventional insulated shipping container.

Another object for the present invention to provide an insulated shipping container; which is more material-efficient to make than the conventional insulated shipping container.

Another object for such a new insulated shipping container is that it be substantially recyclable.

Accordingly, the present invention according to one aspect provides an insulated shipping container including a unitary prismatic body of foamed polymer material, the body defining a floor wall and plural side walls cooperatively defining a plurality of cavities within the unitary body, an opening from each cavity, a transition surface surrounding the opening, and an exterior surface of the shipping container, the body further defining an integrally bonded un-foamed polymer sheet facing each cavity, the transition surface, and at least that portion of the exterior surface defined by the side walls.

An advantage of this invention is that the insulated shipping container is durable enough to endure several shipments, if desired. In the event that the container is to be used only one time, it is substantially recyclable.

The invention according to another aspect provides a plastic bag article of manufacture for use in making an insulated shipping container having a body of foamed polymer material substantially contained within the plastic bag article, the body of foamed polymer material defining multiple chambers therein and an opening outwardly from the chambers surrounded by a transition surface, the plastic bag article including a generally or somewhat rectangular end portion; and a curved or flaring skirt section extending from the rectangular end portion to a transverse line at which the bag defines a hoop dimension sufficient to allow the bag to extend across the transition surface of the body of foamed polymer material.

According to another aspect, the present invention provides a method of making such a compartmentalized shipping container including steps of providing a body of foamed polymer material, and configuring the body to define multiple chambers of various size, each with an opening therefrom to ambient, a transition surface surrounding the opening, and a prismatic external surface; providing a sheet of un-foamed plastic material, and integrally bonding the sheet to the body of foamed polymer material so as to completely face each chamber.

Another additional aspect of the invention is that it provides a machine for use in making an insulated shipping container with multiple compartments according to the present invention. This machine includes a base portion having an internal cavity and defining an upper surface; a source of vacuum connected to the internal cavity of the base portion; plural core members matching in size and shape the plural cavities of the insulated shipping container and disposed upon the base member; an array of cooperative wall members hingeably attached to the base portion and in a first position hinging away from one another to leave the core members exposed upon the base portion, the wall members hinging on the base member to a second position in which the wall members engage one another at adjacent edges and cooperatively define an enclosure surrounding the plural core members in spaced relation thereto.

Still additionally, the present invention provides a heat-sealing table for use in making a plastic bag used in an insulated shipping container, and including: a table-like base portion with a flat table-like upper surface defining a cavity, the cavity having a sloping floor wall, two side walls, a front wall. A heat sealing margin is defined about three sides of the perimeter of the cavity, and selectively controllable vacuum source capable of supplying sufficient vacuum force on two plastic sheets as to hold them firmly in place within the cavity and upon the heat-sealing margin.

Additional features and advantages of the present invention may be appreciated from a reading of the following detailed description of selected and particularly preferred exemplary embodiments of the invention, taken in conjunction with the appended drawing figures, in which like reference numerals designate like features, or features which are analogous in structure or function.

BRIEF DESCRIPTION OF THE DRAWING FIGURES

FIG. 1 provides a perspective view of a shipping container embodying the present invention, which container defines plural internal cavities, and is illustrated with a portion of the wall of this container closest to the viewer broken away for clarity of illustration;

FIG. 2 provides a perspective view of a machine used in making the container seen in FIG. 1;

Figure 1:
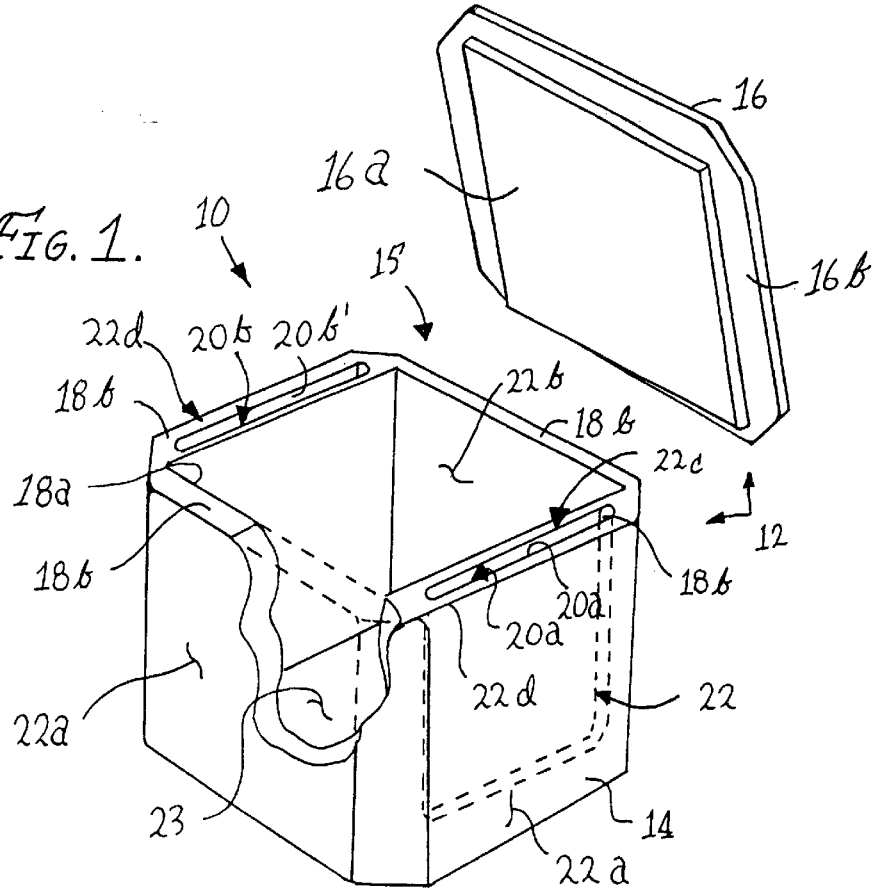
Figure 5A:
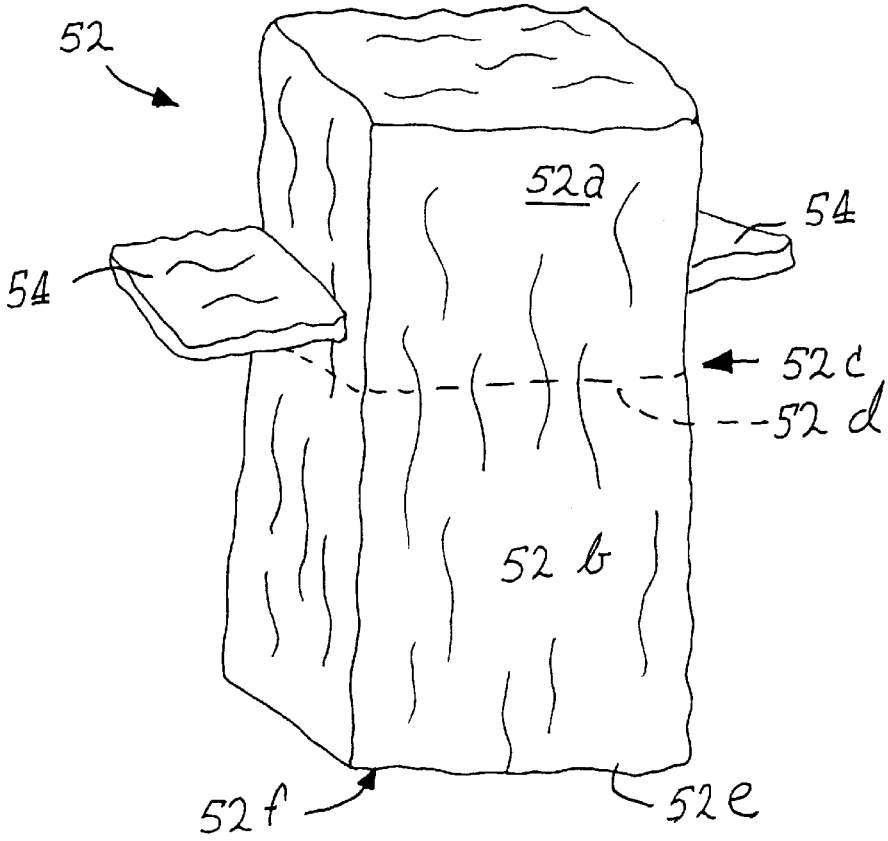
Figure 5B:
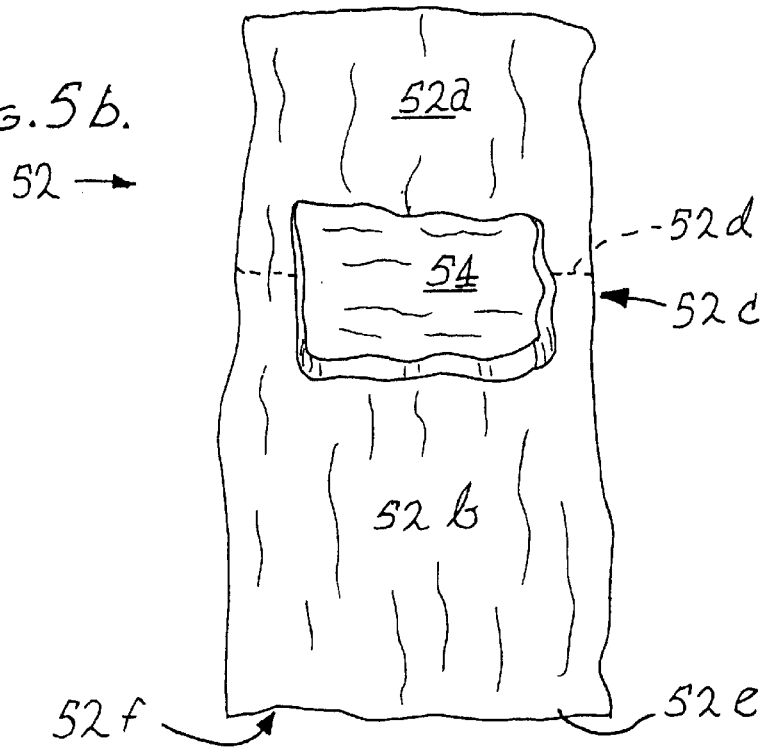

FIG. 5*a* is a perspective view of a plastic bag article of manufacture especially configured for use in the process of making an insulated container as seen in FIG. 1;

FIG. 5*b* is a side elevation view of the plastic bag article of manufacture seen in FIG. 5*a;*

Figure 5C:
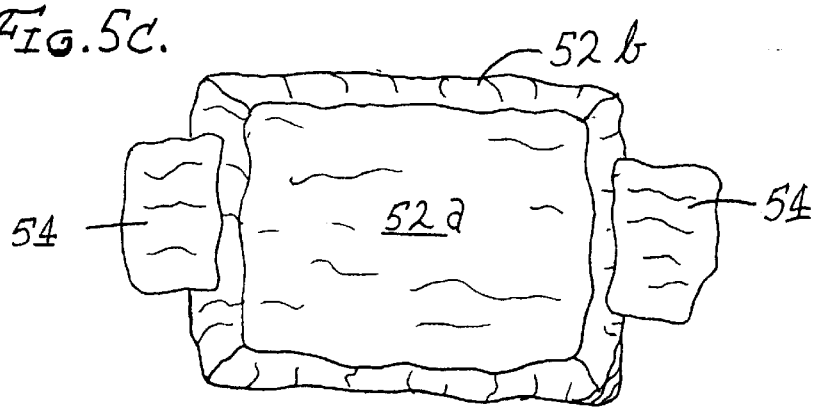

FIG. 5*c* is plan view of the plastic bag article of manufacture seen in FIGS. 5*a* and 5*b;*

Figure 6:
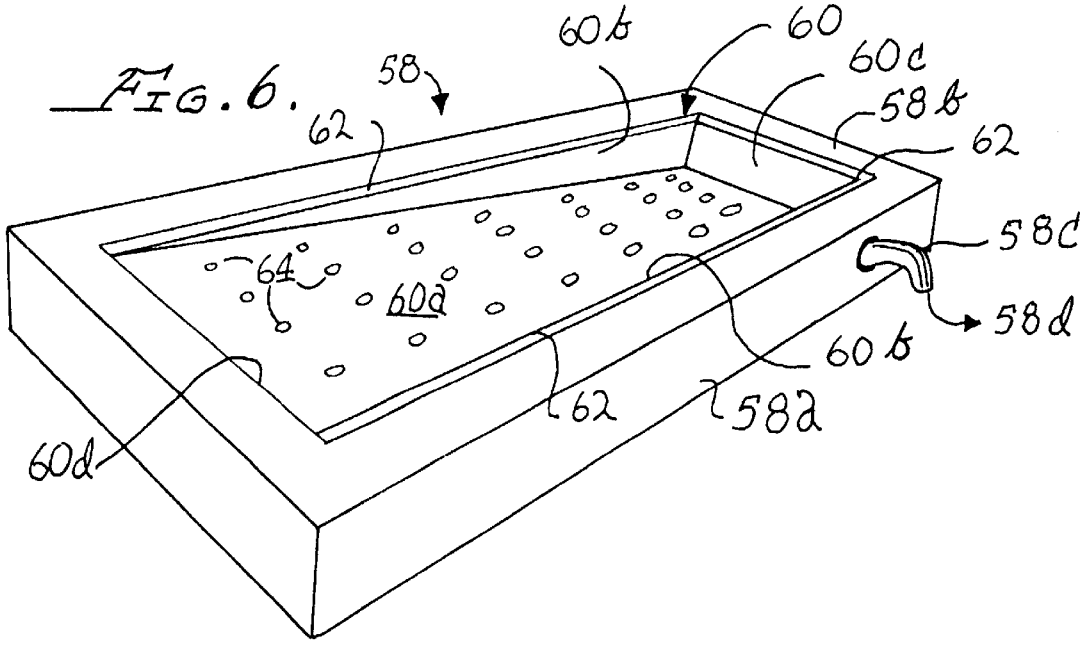
Figure 7:
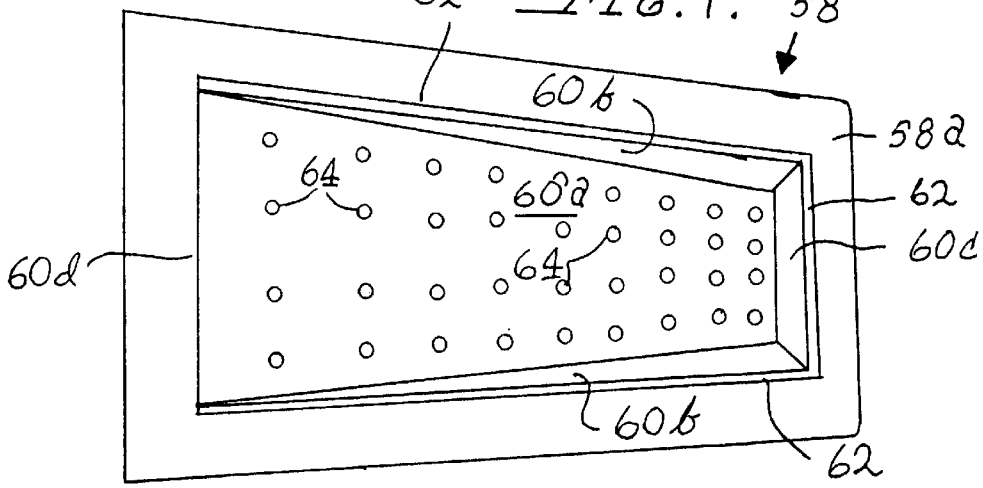
Figure 8:
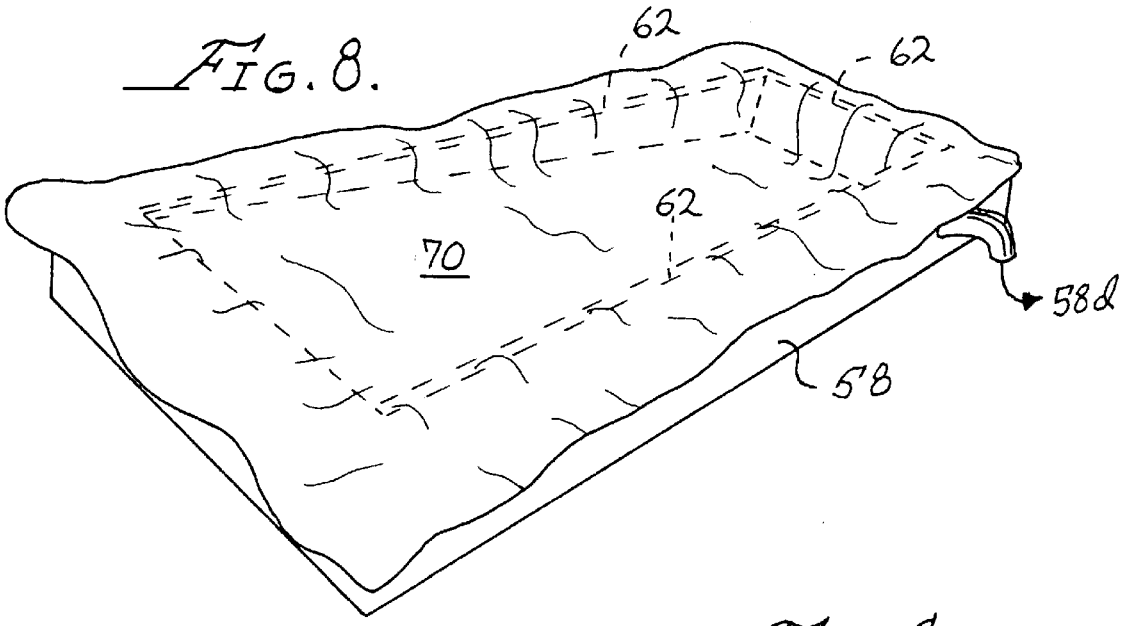
Figure 9:
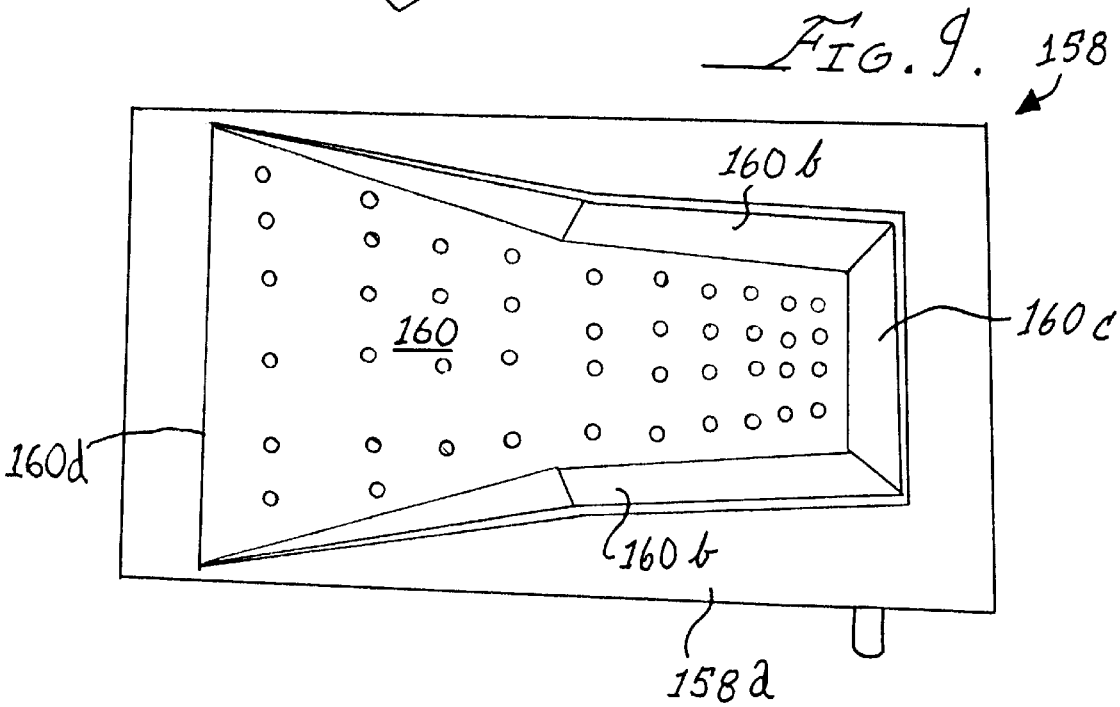
Figure 10:
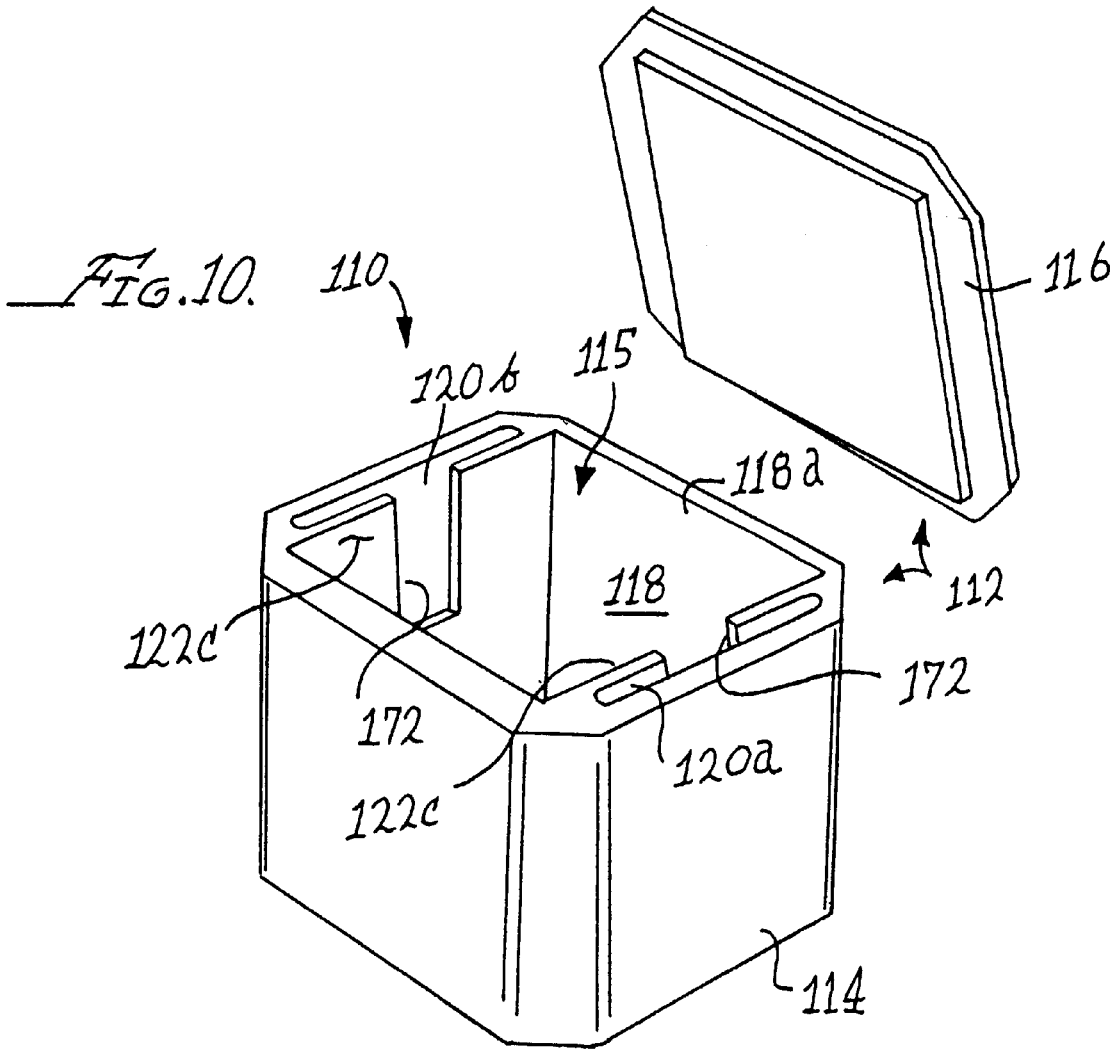

FIG. 6 is a perspective view of a machine used in making a plastic bag article of manufacture;

FIG. 7 is a plan view of the machine seen in FIG. 6;

FIG. 8 is a perspective view of the machine seen in FIGS. 6 and 7, but in this Figure the machine is shown at a particular step in the manufacturing process of making a plastic bag article of manufacture;

FIG. 9 shows a plan view of an alternate embodiment of a machine as is seen in FIGS. 6 through 8; and FIG. 10 shows a perspective view of an alternate embodiment of an insulated shipping container embodying the present invention, and having plural internal cavities all communicating with one another.

DETAILED DESCRIPTION OF EXEMPLARY PREFERRED EMBODIMENTS OF THE INVENTION

Viewing FIG. 1, an insulated shipping container 10 embodying the present invention is depicted in perspective view. The shipping container 10 includes a chambered prismatic body 12 including a lower portion 14 having plural internal cavities generally referenced with the numeral 15, and a lid 16. The cavities 15 of the lower portion 14 includes a primary cavity 18 forming an upwardly directed opening 18*a* on the lower portion 14. On two opposite sides of the primary cavity 18, the body 14 also defines a pair of secondary cavities 20*a* and 20*b*. Each of the secondary cavities 20*a* and 20*b* defines one of a pair of respective upwardly directed opening 20*a*' and 20*b*' also opening on the body 14 on opposite sides of the opening 18*a*. About the openings 18*a* and 20*a*', 20*b*' of the cavities 15, the container 10 defines a transition surface 18*b*, extending outwardly from each opening to the out surfaces of the container. The transition surface 18*b* also extends between the openings 20*a*', 20*b*', and the opening 18*a*.

Viewing the container 10, it may be appreciated that the configuration of the two smaller secondary cavities 20*a* and 20*b* allows their use for holding documentation relating to an article which is shipped in the primary cavity 18. However, the secondary cavities 20*a* and 20*b* are not limited to such use, and the size and shape of these cavities may be other than as illustrated in the exemplary preferred embodiment. For example, one or more of the cavities 15 may be other than square or rectangular. One or more of the cavities 15 may be round or oval in plan view, for example. Further, the container 10 may have only a pair of cavities, or may have plural cavities numbering more than thee. For example, the container 10 may have four cavities, so that each side wall around a main cavity also defines a secondary cavity. Still alternatively, the container 10 may define plural cavities that number four or more, and which may be closer to the same volume to one another than is the case with the exemplary preferred embodiment seen in FIG.

Viewing the lid 16, it is seen that in plan view this lid matches the rectangular shape of the lower portion 14, and includes an extension portion 16*a* generally matching the shape of and received into the upper extent of the primary cavity 18. The secondary cavities 20*a* and 20*b* are covered by an overhanging lip portion 16*b* of the lid 16. The Lid 16 may be made of any chosen material, such as Styrofoam for example, but is preferably made of a foamed polymer material, the same as that of the lower portion 14. Preferably, both the lower portion 14 and lid 16 are made principally of foamed polyurethane material. Accordingly, it is to be understood that the lid 16 may be removably attached to the lower portion 14 of the shipping container 10, for example, by the use of strips of adhesive tape, as is well known in the shipping container art. Alternatively, the container 10 may be utilized with another type or configuration of lid. For example, the lid need not include portion 16*a* in order to be used with the container 10.

It is to be noted viewing FIG. 1, that side walls 22 of the body 12 have outer surfaces 22*a* and inner surfaces 22*b*. The opposite side walls that define secondary cavities 20*a* and 20*b* are thicker than the adjacent pair of side walls, so that although this preferred exemplary embodiment of the container 10 is generally square in plan view (i.e., with chamfered corners in plan view), the cavity 18 is rectangular, with the shorter rectangular dimension extending between the secondary cavities 20*a* and 20*b*. The side walls 22 which do define cavities 20*a* and 20*b* have two wall portions, indicated on FIG. 1 with the numerals 22*c* for the inner side wall portion, and 22*d* for the outer side wall portion. It will be understood that the cavities 20*a* and 20*b* may not extend the full vertical depth of the side walls 22 (as is indicated in dashed lines in FIG. 1) so that below the bottom of the cavities 20, these side walls have a single thicker section. The container 10 also includes a floor wall portion 22*e*, seen through the broken away portion of perspective FIG. 1.

Figure 2:
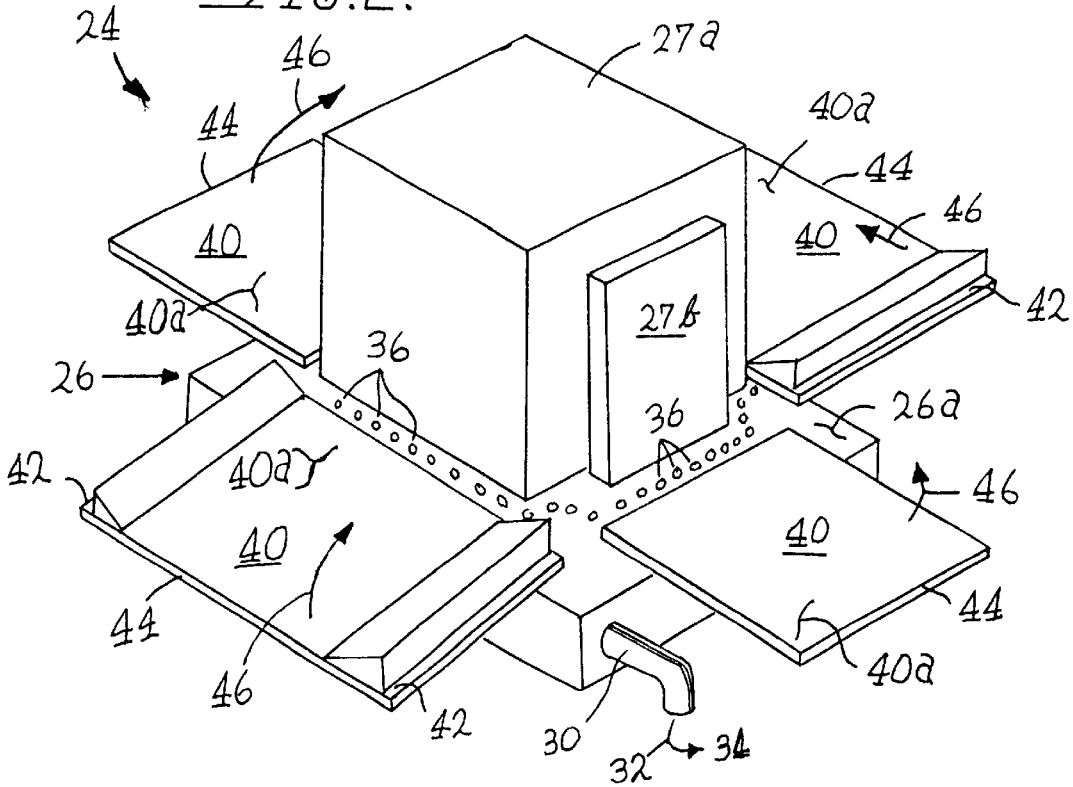

FIG. 2 provides a perspective view of a machine 24 used in making the body 14 of the lower portion 12 of the shipping container 10 seen in FIG. 1. This machine 24 includes a hollow or chambered base portion 26 defining an upper surface 26*a* and an internal chamber (not seen in the drawing Figures), which internal chamber is closed except as described below. A controllable vacuum source (further described and referenced below) has connection to the internal chamber of the base portion by communicated with a conduit 30. Controlled outflow of air 32 from this internal chamber results when the controllable vacuum source (represented by arrowed numeral 34) is turned or valved on. As a result, the air 32 is ejected from the internal chamber so that this chamber is maintained at a partial vacuum.

Disposed upon the upper surface 26*a* is a prismatic main core member 27*a* matching in shape and size the primary cavity 18 in the lower portion 14 of the shipping container 10. Also on the upper surface 26*a* and opening to the chamber 26*b* is a peripheral array of comparatively small holes 36. The array of holes 36 circumscribes the main core member 27*a*. Outside of the array of holes 36, the base 26 hingeably carries four wall members 40, which are arranged in a square array. Each of the four wall members 40 defines a respective upper edge surface 44, which upper edge surfaces 44 are all at the same level as one another when the four wall members 40 are pivoted upwardly (as is indicated by arrows 46) so that the four wall members 40 inter-engage (Viewing FIG. 4, for reference). Opposite ones of the wall members 40 define rabbit edges 42, which engage the other two wall members 40 so that the four wall members 40 can inter-engage one another in a mutual supporting relationship (viewing FIG. 4 again for reference). The wall members 40 each define respective inner surfaces 40*a*, which cooperatively bound a cavity 40*b*, surrounding the core member 27*a* and best seen in FIG. 4.

Also seen in FIG. 2 is one of two secondary core members 27*b*, which like the core member 27*a*, are attached to the base portion 26 in a side-by-side relationship. The two secondary core members 27*b* are spaced from the main core member 27*a*, and cooperate with the main core member 27*a* to leave a small space therebetween. This space serves to create one portion of one of the inner walls of the shipping container. Further, as will be explained below, the secondary core members 27*b* each receive over them a "pocket" portion of a plastic bag which is used in the process of making the insulated container 10.

Figure 3:
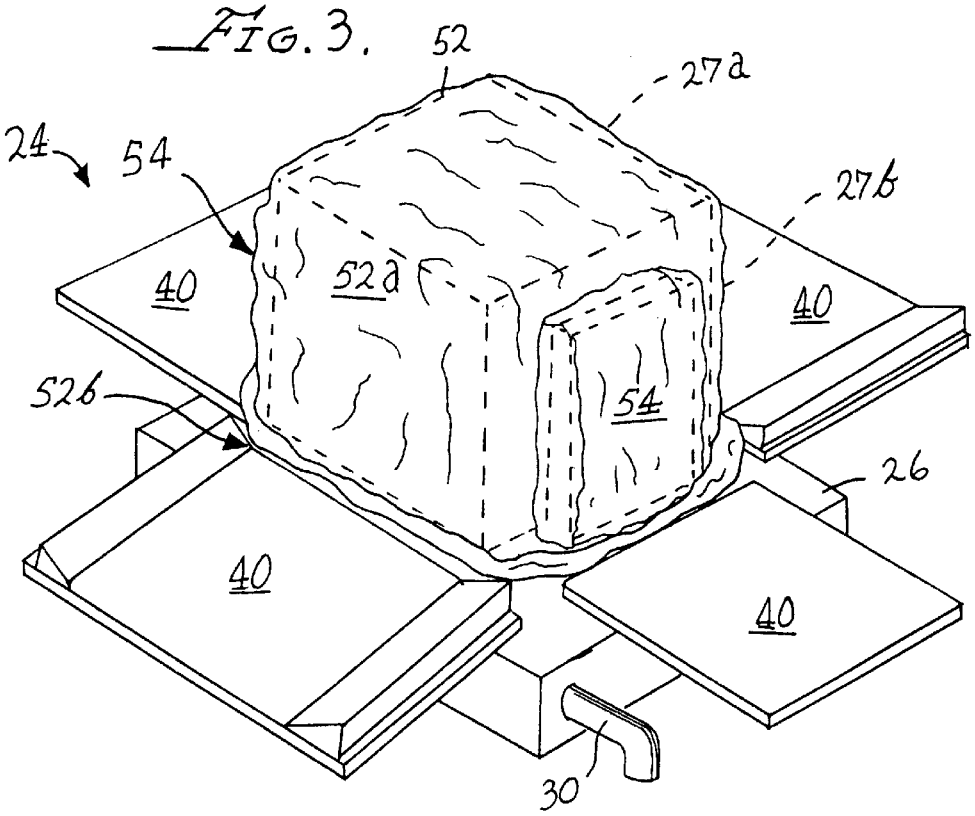
FIG. 3 is another view of the machine shown in FIG. 2, with the machine seen as it appears during an initial step in the manufacturing process.

FIG. 3 provides another view of the machine 24 shown in FIG. 2. Here in FIG. 3, the machine 24 is shown with a plastic bag 52 in place upon the core members 27*a* and 27*b* in preparation for making a lower portion 14 of the shipping container 10. The larger portion 52*a* of the plastic bag 52 can be seen fitted and draped over the main core member 27*a* with two smaller pockets 54 of the plastic bag 52 being fitted upon the secondary core members 27*b*. As seen in FIG. 3, a portion of the plastic bag 52 is drawn by vacuum onto the upper surface 26*a* of the base portion 26, and the bag 52 is also drawn tightly onto the main core member 27*a* and onto the secondary core members 27*b*. A skirt portion 52*b* of the plastic bag 52 can be seen in FIG. 3 bunched around the bottom of the core members 27*a* and 27*b*.

Figure 4:
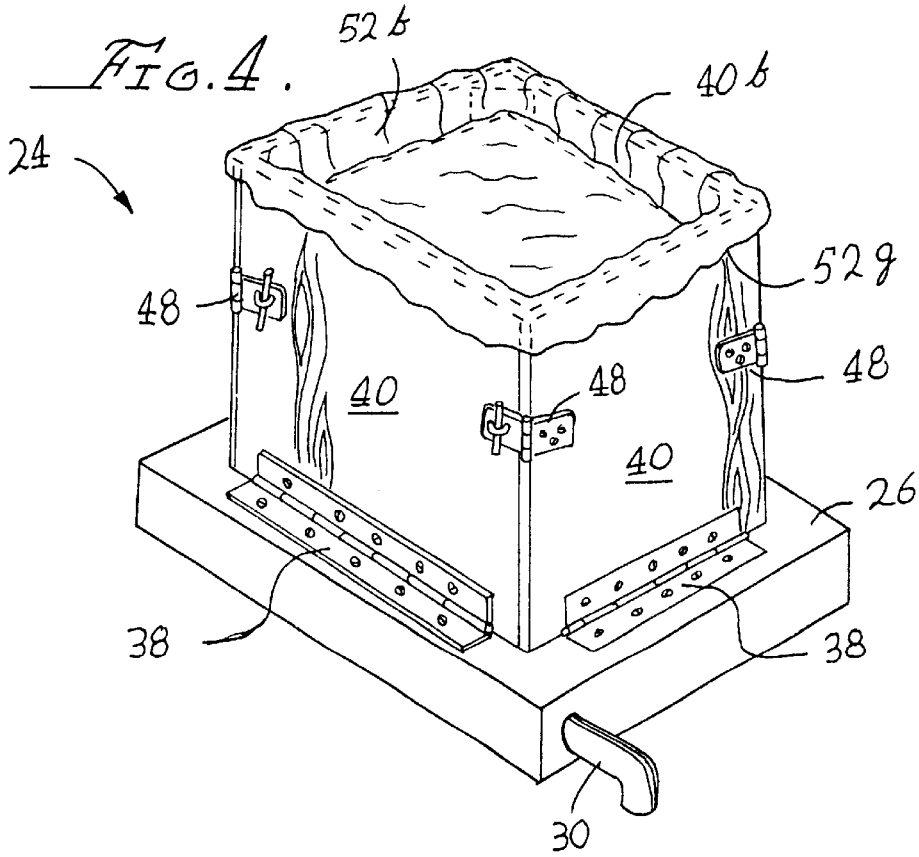
FIG. 4 is another view of the machine as seen in steps 2 and 3 as it appears during another step in the manufacturing process.

FIG. 4 shows the machine 24 with the walls 40 hinged upwardly to their closed positions, cooperatively forming cavity 40*b* (which is noted to have a depth greater than the height of the cores 27*a* and 27*b*), and the skirt portion 52*b* of the plastic bag 52 is seen to be drawn upwardly and over the inner surfaces 40*a* of these walls 40 to be wrapped over the top surfaces 44 of these walls. That is, the bag 52 is received over the main core member 27*a*, and over the core members 27*b*, and it is gathered by vacuum to fit closely on these core members.

Because the wall members 40 are closed, the secondary core members 27*b* cannot be viewed in FIG. 4, but is to be appreciated that the vacuum from within base portion 26 also draws the pockets 54 of the plastic bag 52 down tightly over them. As will be further explained, the plastic bag 52 includes a transition section 52*e* of sufficient hoop dimension so as to allow the plastic bag 52 to extend across the upper surface 26*a* of the machine 24 between the core member 27*a* and the inner surfaces 40*b* of the walls 40 in order to cover the surface of the lower portion 26, recalling the description above. Also, as also will be further explained, the plastic bag 52 includes a skirt portion 52*c* which may be straight or may continue to flare slightly beyond the transition section 52*e* toward the open edge 52*g* such that the plastic bag 52 can be turned down over the top edge surface 44 of the inter-engaged wall members 40.

As thus positioned, the plastic bag 52 defines a circumferential cavity 28 within the wall members 40 and around the core members 27. The surface of the plastic bag 52, which faces the cavity 28 is treated (i.e., by ozone exposure or by plasma exposure, for example) so that the foamed polymer material can bond to this surface. Liquid pre-foam material for making the polymer is injected into the cavity 28 in a measured quantity. This liquid pre-foam then over a period of time (i.e., a few minutes) foams, expands, and solidifies, to form the lower portion 14 of body 12 for container 10. As will be understood to those ordinarily skilled in the pertinent arts, during this foaming, expansion, and solidification of the foam material, the cavity 28 is closed by a rigid lid portion of machine 24 (not illustrated in the drawing Figures), which lid is secured at the uppers surfaces 44 of the side walls 40.

Considering the machine 24 as seen in FIG. 4 once again, it is seen that spaced from the main core member 27*a* and hingeably attached to the base portion 26 by respective hinges 38 is an array of four wall members 40, which are facially of the same size and shape as the outer surfaces 22*a* of the side walls 22 of the lower portion 14 of the shipping container 10. The wall members 40 are spaced from the core members 27*a* and 27*b* by a distance equal to the thickness of the side walls 22. The core members 27*b* are spaced from core member 27*a* by a distance equal to the thickness of the wall portions 22*c*. The upper edge surface 44 is disposed above the top of the main core member 27*a* by about the same distance as the horizontal space between the core members 27 and wall members 40. Thus, the container 10 has a floor 22*e* that is about the same thickness as the side walls 22 (i.e., the pair of side walls not defining cavities 20*a* and 20*b*). Wall members 40 are provided with latching devices 48 so that they may be selectively latched in and released from the position of FIG. 4.

In order to further understand the manufacturing process and apparatus used to make container 10, attention now to FIG. 5*a* will show a perspective view of a plastic bag article of manufacture 52 especially configured for use in the process of making a compartmentalized insulated shipping container as seen in FIG. 1. As a result of the manufacturing process, the plastic bag 52 becomes a part of the container 10. That is, the container 10 has internal and external surfaces that are "surfaced" with un-foamed plastic sheet material. The bag 52 provides that plastic sheet material, which is bonded to the foamed material forming the bulk of the container 10.

Viewing FIGS. 5*a*, 5*b*, and 5*c* in conjunction, it is seen that the plastic bag 52 includes a closed head portion 52*a*, which will be utilized in surfacing the primary cavity 18 of the insulated shipping container 10. Below the portion 52*a*, a pair of appendage-like pockets 54 stick out from opposite sides of the plastic bag 52. These pockets are used to line the secondary cavities 20*a* and 20*b*. The plastic bag 52 below the pockets 54 includes a skirt portion 52*b*, which at a transition portion 52*c* defines a hoop dimension (indicated by dashed line 52*d*) at which the skirt portion 52*b* of the bag 52 is of sufficient hoop dimension to be pulled onto the surface 26*a* of the machine 24, recalling FIGS. 2 and 3. As thus positioned, and after the introduction and foaming of the foamed polymer material making the bulk of the container 10, this portion 52*c* surfaces the transition surface 18*b*.

Below the transition portion 52*c*, the skirt portion 52*b* of the bag 52 may be more or less flaring, according to and somewhat dependent upon the thickness of the walls 22. That is, the skirt portion 52*b* may be outwardly flaring so as to provide sufficient bag material to allow this skirt to be pulled up and over the walls 40 (recalling FIG. 4) along side of that portion 52*a* of plastic bag 52 surfacing the primary cavity 18, as well as along side of the pockets 54 surfacing the secondary compartments 20*a* and 20*b* (viewing FIG. 4 once again). It will thus be understood that the skirt portion 52*b* of the bag 52 also surfaces the outside of the insulated shipping container 10 like a skin. Finally, the bag 52 includes a marginal end portion 52*e*, or end edge portion, defining the opening 52*f* into the bag 52.

FIGS. 6, 7, 8, and 9 in conjunction depict a forming and heat-sealing table 58 which is utilized in the manufacture of a plastic bag usable in the making of an insulated shipping container. This table 58 includes a chambered base portion 58*a* with a table-like upper surface 58*b*. This upper surface 58*b* defines a trapezoidal cavity 60. The cavity 60 includes a trapezoidal floor wall 60*a*, two opposed side walls each indicated with the numeral 60*b*, a front wall 60*c*, and a transition (indicated with the numeral 60*d*) at which the upper surface 58*b* of the table 58 "breaks" to slope downwardly into the cavity 60. The heat-sealing table 58 further includes a heat-sealing margin 62 running along three sides of the cavity 60 (i.e., the margin 62 not running along the "break" 60*d*), and a conduit 58*c* connecting the cavity of the table 58 to a controllable source of vacuum, as is indicated by arrowed numeral 58*d*.

In FIG. 6 it is seen that the floor wall 60*a* of the cavity 60 starts at a level just below the surface 58*b* (i.e., just forwardly into the cavity 60 beyond the "break" 60*d*) and progresses onward at a shallow angle towards the rear wall 60*c*. The floor 60*a* joins with the pair of side walls 60*b*, and with the end wall 60*c* at intersection angles less than but approaching perpendicular.

Those portions of the surface of cavity 60 defined by the floor 60*a*, as well as possibly by the pair of side walls 60*b*, and by front wall 60*c*, define multiple perforations 64 communicating into the cavity of the base 58*a*, and thus, connecting to the controllable source of vacuum 58*d* via conduit 58*c*.

As can be better seen in FIG. 8, the table 58 is utilized to apply vacuum force to hold a pair of plastic sheets 70 in place within the cavity 60 during heat sealing of these plastic sheets together to form a plastic bag. Each of the pair of plastic sheets 70 has one face which is treated (for example, by plasma or ozone exposure) so as to allow that face to bond to foaming polymer forming an insulated container, such as container 10. As disposed on the table 58, the sheets 70 have each of these treated faces toward or away from one another.

Returning to FIGS. 6 and 7, it is to be recalled that the surface 58*b* of the base portion 58*a* contains a heat margin 62 adjacent to three sides of the cavity 60. This heat sealing margin is immediately adjacent to the two side walls 60*b* and to the front wall 60*c*. In order to effect a heat sealing of the pair of sheets 70 to one another while they are held by vacuum force into the cavity 60 (recalling FIG. 8), a heat sealing tool, for example, may be run along the margin 62. Alternatively, or in addition to the use of a heat sealing tool, the margin 62 may contain a heating element so that when heat is applied to the pair of sheets 70, they mutually bond sealingly to one another at the margin 62. In this way, a plastic bag is created with a large opening and a flaring skirt which is capable of being used in the process of making an insulated shipping container.

FIG. 9 depicts another embodiment of a heat sealing table similar to the table 58 according to this invention. This alternative embodiment of heat sealing table seen in FIG. 9 is utilized to make a plastic bag of slightly different shape from the bag shape resulting from the use of table 58 seen in FIGS. 6–8. In other words, it will be seen that the table configuration of FIG. 9 provides a bag with a more broadly flaring skirt portion, and can thus accommodate the making of containers having thicker walls.

Because the table 58 of FIGS. 6–8, and the table of FIG. 9 share many similarities, features of FIG. 9 which are the same as or which are analogous in structure or function to those of FIGS. 6–8 are indicated with the same numeral used above, and increased by one-hundred (100). Viewing now FIG. 9, it is seen that the heat-sealing table 158 has a base portion 158*a* defining a cavity 160. Along the length of this cavity 160 is seen that the pair of opposed side walls 160*b* flare outwardly as they extend from the front wall 160*c* toward the line 160*d*. That is, at a point approximately half the length of the cavity both side walls 160*b* alter direction and increase their flare with respect to the front wall 160*c*, finally reaching the line 160*d* where they form a union with this line 160*d*.

FIG. 10 depicts an insulated shipping container 110 embodying the present invention. Similarly to the container 10 depicted in FIG. 1, the container 110 defines a chambered prismatic body 112 including a lower portion 114 having plural internal cavities, generally indicated with the numeral 115. A lid lid 116 may be provided to close the cavities 115. Again, the lower portion 114 defines a primary cavity 118 and an opening to this cavity 118*a*. On two sides of the primary cavity 118 the body 112 defines respective ones of a pair of secondary cavities 120*a* and 120*b*. However, Viewing FIG. 10, it is seen that the configuration of these cavities 118, 120*a*, and 120*b* differs from the analogous cavities of FIG. 1. That is, in the container 110 of FIG. 10, the cavities 115 all communicate one with another via respective ones of a pair of slots 172 formed in the separating side wall 122*c*.

An advantage that results from the configuration of the container 110 is that the cavities 120*a* and 120*b* may each receive a respective slab of dry ice or other refrigerant. Further, the cavities 120*a* and 120*b* communicate with cavity 118 so that cool air (or other cool fluid, such as carbon dioxide from dry ice) can pass from the dry ice or refrigerant to the cavity 118 so as to maintain cooling of the item(s) shipped in the container 110. It will be apparent that a container embodying the present invention may have only two cavities, or may have more than the three cavities illustrated. Further, not all of the cavities need communication with one another. For example, a container embodying the present invention may have four cavities which communicate with one another in pair, but with the pairs of cavities not communicating with one another. This embodiment has the advantage that items shipped in the container may be maintained at differing temperatures. For example, an item in one of the cavities may be maintained at a cool temperature by use of a refrigerated gel pack or by use of water ice located in its communicating cavity. On the other hand, an item in another of the cavities may be maintained at freezing temperature by use of dry ice located in its companion cavity. Because the pairs of cavities do not communicate with one another, the cooled cavity does not warm the freezing cavity, and conversely, the freezing cavity does not overly chill the cooled cavity. In this way a single container can be used to ship item requiring differing conditions for their preservation during shipment.

Those skilled in the pertinent arts will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiment which has been described in detail herein. Rather, reference should be made to the appended claims to define the spirit, scope, and content of the present invention.

I claim:

1. An insulated shipping container with plural compartments, said container comprising: a unitary prismatic body of foamed polymer material, said body including a floor wall and plural walls extending generally perpendicularly to the floor wall to cooperatively define plural compartments each having a respective interior surface, said plural compartments defining respective ones of plural openings on said container, external ones of said plural walls cooperatively defining an external surface for said container, a transition surface extending about said plural openings on an exterior of said container, said body further including an integrally bonded flexible un-foamed polymer sheet of material that is not self-supporting, and said polymer sheet being adherent, conformal to and supported by said body of foamed polymer material and said un-foamed polymer sheet facing all of said interior surface of each of said plural compartments, said transition surface, and said external surface, and said polmer sheet further including at least one pocket portion facing at least one of said plural compartments.

2. An insulated shipping container with plural compartments comprising: a unitary prismatic body of foamed polymer material, said body defining a floor wall which is substantially uniformly thick and substantially free of fissures, plural exterior side walls encompassing the container, and multiple interior side walls dividing the container into various plural compartments, said floor wall and side walls cooperatively defining said compartments, an opening from each said compartment, a transition surface encompassing the plurality of openings from all said compartments, and an exterior surface of said shipping container, said body further including an integrally bonded flexible un-foamed polymer sheet facing the interior of each said cavity, said transition surface, and that portion of said exterior surface defined by said exterior side walls; said un-foamed polymer sheet having a transition portion which faces said transition surface and being conformed to, integrally bonded to, and supported by said unitary prismatic body of foamed polymer material, and said un-foamed polymer sheet including at least one pocket portion surfaceing at least a respective one of said plural compartments.

3. The compartmentalized, insulated shipping container of claim 2 further including a closer member of closed-cell foam material removably force fitting into said compartmentalized openings and engaging said integrally bonbed un-foamed polymer sheet.

4. The compartmentalized insulated shipping container of claim 2 further including a lid member configured to span and close all said compartment openings, said lid member including an extension portion extending into said chamber of said container.

5. An insulated shipping container comprising: a unitary prismatic body of foamed polymer material, said body defining a floor wall and plural side walls cooperatively defining a plurality of cavities within said body, said floor wall and said side walls each being substantially uniformly thick and substantially free of fissures; said side walls cooperatively defining: an opening from each of said plural cavities, a transition surface surrounding all said cavity openings, and an exterior surface of said shipping container; said body further including an integrally bonded flexible un-foamed polymer sheet facing all exterior surfaces of said body of foamed polymer material including those surfaces bounding each cavity, said un-foamed polymer sheet being conformnal to and supported by said unitary prismatic body of foamed polymer material, said un-foamed polymer sheet including a transition portion extending between a pair of adjacent portions of said un-foamed polymer sheet which are of differing cross sectional area, one of said adjacent portions of said un-foamed polymer sheet including a pocket portion surfacing at least a respective one of said plural cavities, and said transition portion facing said transition surfaces of said body of foamed polymer material with one of said pair of adjacent portions facing said at least one cavity and the other of said pair of adjacent portions facing an exterior surface portion of at least one of said side walls.

6. An insulated shipping container comprising: a unitary prismatic body of foamed polymer material, said unitary prismatic body defining a floor wall which is substantially uniformly thick and substantially free of fissures and plural side walls which are substantially uniformly thick and substantially free of fissures, said plural side walls cooperatively defining plural cavities within the unitary prismatic body, said plural cavities defining respective ones of plural openings on said unitary body of foamed polymer material, a transition surface surrounding all of said plural openings, an exterior surface of said shipping container; said body further including a unitary integrally-bonded flexible un-foamed polymer sheet facing all of each said plural cavities, said transition surface, and that said exterior surface of said unitary prismatic body which is defined by said plural side walls, said un-foamed polymer sheet including a first portion having a size and shape substantially matching said at least one cavity of said plural cavities at said floor wall, and said un-foamed polymer sheet further including a transition portion facing said transition surface of said foamed polymer body, said transition portion including a part of said un-foamed polymer sheet defining a hoop dimension sufficient to circumscribe said foamed polymer body at said exterior surface, and said part of said transition portion facing a corresponding part of said exterior surface of said foamed polymer body, and said un-foamed polymer sheet further comprising a plurality of pockets, each said plurality of pockets being conformal to and supported within a respective cavity of said unitary prismatic body of foamed polymer material.

* * * * *